United States Patent [19]

Takatsuki et al.

[11] Patent Number: 4,984,611

[45] Date of Patent: Jan. 15, 1991

[54] VACUUM STORAGE DEVICE

[75] Inventors: Toyohiko Takatsuki, Izumi; Atsushi Kirimoto, Nara; Toshiyuki Nanba, Takarazuka, all of Japan

[73] Assignee: Zojirushi Corporation, Osaka, Japan

[21] Appl. No.: 355,017

[22] Filed: May 22, 1989

[30] Foreign Application Priority Data

Apr. 5, 1989 [JP] Japan ..... 1-86300

[51] Int. Cl.[5] ..... B65D 51/16

[52] U.S. Cl. ..... 141/65; 215/228; 215/260; 53/88; 53/103; 53/105

[58] Field of Search ..... 141/65, 8, 7; 53/88, 53/103, 105, 107; 215/228, 311–315, 260; 99/472

[56] References Cited

U.S. PATENT DOCUMENTS

| | | | |
|---|---|---|---|
| Re. 3,080 | 8/1868 | Squire | 215/260 |
| 578,410 | 3/1897 | Lord | 99/472 |
| 1,601,705 | 9/1926 | Staunton | 141/65 |
| 1,638,383 | 8/1927 | Winters | 141/65 |
| 2,335,502 | 11/1943 | Exley | 141/65 |
| 3,414,160 | 12/1968 | Weber | 141/65 X |
| 3,425,464 | 2/1969 | Hughes | 141/7 |
| 3,650,429 | 3/1972 | Ribout | 141/65 |
| 3,672,114 | 6/1972 | Sacks | 53/88 |
| 4,051,971 | 10/1977 | Saleri et al. | 215/260 |
| 4,249,583 | 2/1981 | Lundbladh | 141/65 |
| 4,278,114 | 7/1981 | Ruberg | 141/65 |
| 4,763,803 | 8/1988 | Schneider | 215/260 |

FOREIGN PATENT DOCUMENTS

| | | | |
|---|---|---|---|
| 0429832 | 6/1926 | Fed. Rep. of Germany | 53/103 |

*Primary Examiner*—Henry J. Recla
*Assistant Examiner*—Casey Jacyna
*Attorney, Agent, or Firm*—Jones, Tullar & Cooper

[57] ABSTRACT

A vacuum storage device comprises a closed vessel for storing food with an air exhaust port provided with a check valve, and a pressure reducing device for drawing out air in the closed vessel with a suction port, either of the closed vessel or the pressure reducing device being provided with structure for hermetically connecting the suction port of the pressure reducing device to the air exhaust port of the closed vessel, the pressure reducing device and closed vessel being removably and hermetically connected to one another by mounting the former on the latter or vice versa.

7 Claims, 5 Drawing Sheets

VACUUM STORAGE DEVICE

FIELD OF THE INVENTION

The present invention relates to a vacuum storage device and, more particularly, to a device for storing food or perishables in a closed vessel at a reduced pressure.

BACKGROUND OF THE INVENTION

In general, vacuum or reduced pressures preserve food from chemical oxidation, decomposition or decay resulting from the propagation of bacteria, and thus vacuum storage has been widely applied to food or perishables. For example, application of vacuum storage can be found in canned food, retorted food and the like. However, a canning or retorting device is too large to preserve a small amount of food, thus making it difficult to store food for a family with a light appetite. In addition, the smaller the amount of food to be treated, the lower is the operation efficiency of the canning device.

For these reasons, there has been developed a device for bagging food. In this device, the food to be stored is put into a flexible bag such as a polyethylene bag, and the bag is deaerated and then hermetically sealed. Such a device makes it possible to produce bagged food with ease, but it is difficult to store food for a long period of time as a large amount of air remains in the bag. In addition, it is difficult with such a device to store liquid food.

To solve such problems, a vacuum storage system has been proposed in Japanese patent application serial No. 63-47654 (corresponding to U.S. Pat. application Ser. No. 287121), that comprises a base plate with a bellows pump, a cover member hermetically and removably mounted on a body to form a pressure reducing chamber, and a closable vessel adapted to be housed in the chamber and used for storing food. In this system, food to be stored is firstly put into the closable vessel, and the vessel is closed with a lid member having a port with a check valve. The closed vessel is then placed in the chamber formed between the base plate and cover member mounted thereon, and the air in the closed vessel is drawn out by the bellows pump.

However, such a vacuum storage device has various disadvantages awaiting a solution. For example, the air in the closed vessel is drawn out by the pressure difference between the closed vessel and the chamber. Thus, it is required to draw out a large amount of air contained in the chamber having a considerably large volume as compared with that of the closed vessel, resulting in a decrease in the pressure reduction efficiency and considerable increase in the time required for the pressure in the closed vessel to be reduced to the desired value. In addition, the vacuum storage system can be operated on the table, but it occupies a relatively large part of the surface area of the table.

SUMMARY OF THE INVENTION

It is therefore an object of the present invention to provide a vacuum storage device which is miniaturized and is improved with respect to pressure reduction efficiency.

Another object of the present invention is to provide a vacuum storage device that is simple in construction and easy to operate.

Still another object of the present invention is to provide a vacuum storage device which is made compact for its domestic use.

These and other objects are solved by providing a vacuum storage device comprising a closed vessel for storing food with an air exhaust port having a check valve, and a pressure reducing device with a suction port for drawing out air in the closed vessel, either of the closed vessel or the pressure reducing device being provided with a means for hermetically connecting the pressure reducing device to the closed vessel, the pressure reducing device and closed vessel being removably and hermetically connected to one another by placing the former in its correct position on the latter or vice versa.

In a preferred embodiment, the closed vessel is composed of a vessel body and a lid provided at its central portion with a central bore serving as an air exhaust port, while the pressure reducing device comprising a vacuum pump is provided at its bottom with an annular projection surrounding a central suction port. The connecting means is provided by a sealing ring of a flexible material mounted on the annular projection of the pressure reducing device. In this case, the closed vessel is hermetically connected to the pressure reducing device by placing the latter in its correct position on the lid of the closed vessel.

In order to determine the position of the pressure reducing device with respect to the closed vessel, it is preferred to provide an annular groove in an upper surface of the lid, and plural locating pins or projections on the bottom of the pressure reducing device. The position of the pressure reducing device is decided by the projections held in the annular groove of the lid when the pressure reducing device is placed on the lid of the closed vessel.

In another embodiment, the lid is provided with a valve housing with a cap screwed thereon, and a valve member is attached at its upper stem portion to the cap and guided at its lower stem portion in the air exhaust port of the lid. The valve is opened or closed by rotating the cap. This valve may be replaced with the one composed of a valve member having at its top end a stopper and on the portion in the housing a disk, a spiral spring inserted in the housing to press with its lower end against the disk and to push the same downward, and an annular sealing member arranged on the lower portion of the valve member to form a seal between the disk and the valve seat.

The above vacuum storage device of the present invention is used in the following manner. Firstly, the food to be stored is put in the vessel body with the lid off, and the vessel body is hermetically closed by the lid. Then, the pressure reducing device is placed in its correct position on the lid of the closed vessel, so that the closed vessel is hermetically connected to the pressure reducing device by the sealing ring. By operating the vacuum pump of the pressure reducing device, the air in the closed vessel is directly drawn out therefrom by the pressure reducing device through the check valve provided on the air exhaust port of the closed vessel. After the internal pressure of the closed vessel has been reduced to about 0.5 atm, the pressure reducing device is stopped and then removed from the closed vessel. At the same time, the check valve of the closed vessel is closed by the atmospheric pressure to seal the air exhaust port of the closed vessel. Thus, the food is stored in the closed vessel at a reduced pressure.

According to the present invention, the closed vessel is directly connected to the suction port of the pressure reducing device, and the air in the closed vessel is drawn out by the pressure reducing device. This makes it possible to improve the pressure reduction efficiency, as well as to reduce the size of the vacuum storage device. Further, the closed vessel is connected to the pressure reducing device by placing the latter on the former, thus making it easy to operate.

The vacuum storage device of the present invention makes it possible to store food for a long time without causing any chemical oxidation and decomposition since the interior of the closed vessel is kept in vacuum of about 0.5 atm.

The invention will be further explained in detail with reference to the accompanying drawings which show, by way of example only, one preferred embodiment thereof.

DESCRIPTION OF THE PREFERRED EMBODIMENTS

Figure 1:
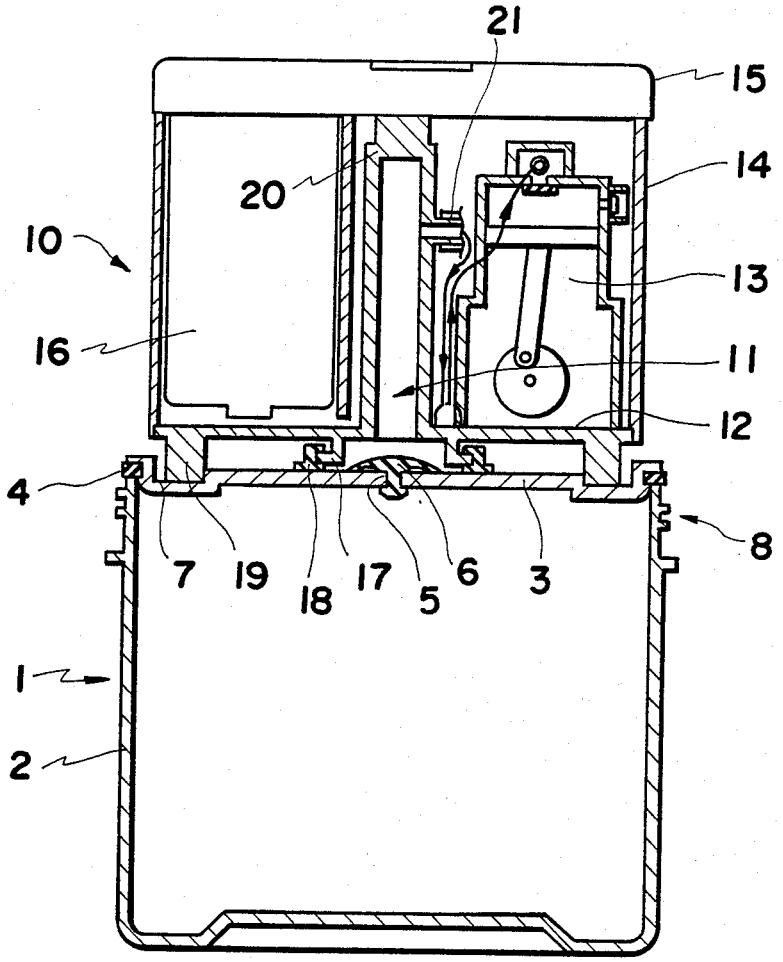
FIG. 1 is a sectional side view of a vacuum storage device embodying the present invention.
Figure 2:
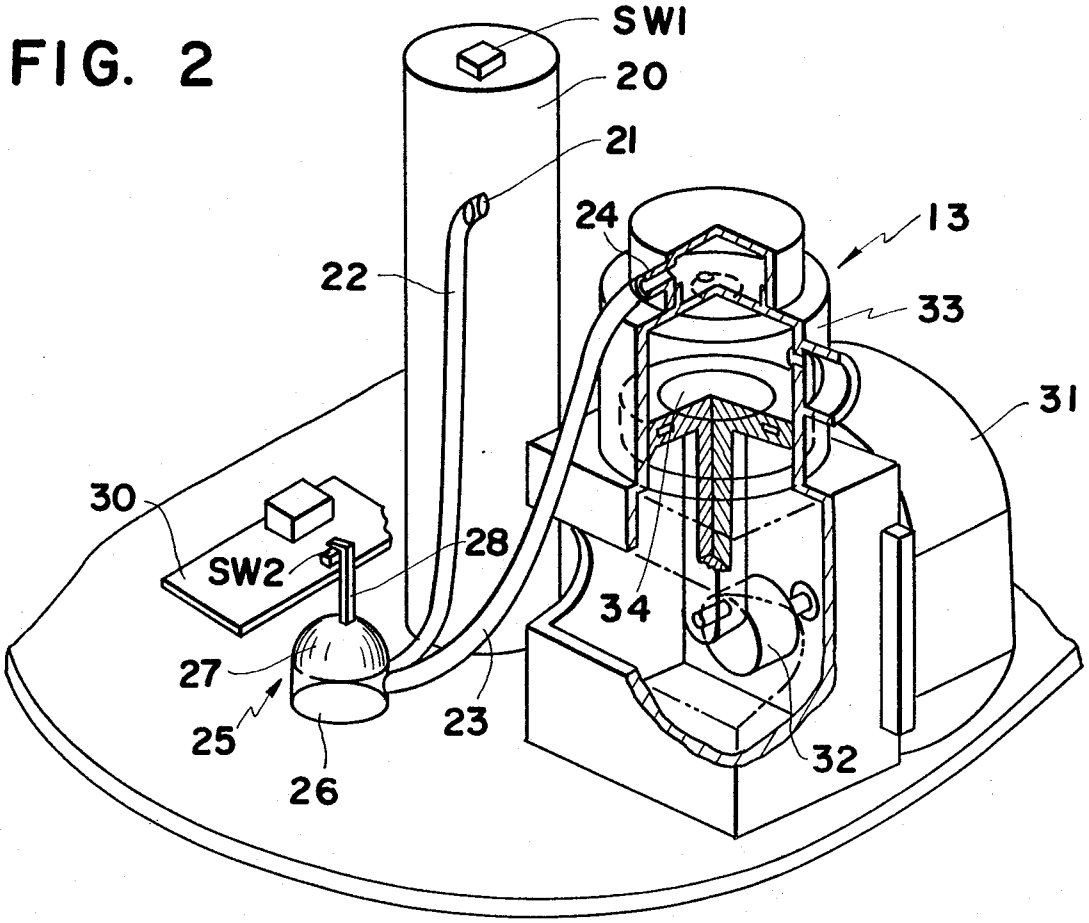
FIG. 2 is a perspective view showing a part of a vacuum storage device of FIG. 1.

Referring now to FIGS. 1 and 2, there is shown a vacuum storage device according to the present invention. The vacuum storage device comprises a closed vessel 1, and a pressure reducing device 10 removably mounted on the closed vessel 1 to draw out air in the closed vessel 1.

The closed vessel 1 is composed of a cylindrical vessel body 2, and a lid 3 fitted in the vessel body 2 by force to hermetically close the opening of the vessel body 2. The lid 3 is provided at its flanged portion with a sealing ring 4 of a resilient material such as silicone rubber or the like material. At the center of the lid, there is provided a bore serving as an air exhaust port 5, to which a mushroom valve member 6 is mounted. The lid 3 is provided in its upper surface with an annular groove 7 coaxially with the lid 3 to determine position of the pressure reducing device 10 with respect to the closed vessel 1.

The pressure reducing device 10 comprises a base member 12 with a suction port 11, an electric powered vacuum pump 13 mounted on the base member 12, a barrel 14 fixed to the base member 12 by screws, and a lid 15 screwed on the barrel 14. The barrel 14 is divided into two chambers, i.e., one for housing the vacuum pump 13, and the other for one or more cell batteries 16.

The base member 12 has on its bottom a flanged annular projection 17 formed coaxially with the suction port 11, and plural locating pins or projections 19. The projection 17 is so designed that it has an inner diameter slightly larger than that of a cap portion of the valve member 6. At the flanged portion of the annular projection 17, there is provided a sealing ring 18 of a silicone rubber to provide a means for hermetically connecting the pressure reducing device 10 to the closed vessel 1.

The locating pins 19 are formed in the position corresponding to that of the annular groove 7 provided in the lid 3 of the closed vessel 1 to determine the position of the pressure reducing device 10 with respect to the closed vessel 1 when the pressure reducing device 10 is placed on the lid 3 of the closed vessel 1. The pins 19 have a length shorter than the free length of the sealing ring 18 by a predetermined value. This ensures that the suction port 11 of the pressure reducing device 10 is hermetically connected to the air exhaust port 5 of the closed vessel 1 when the former is placed on the latter.

The base member 12 is provided at its central portion with a top-closed suction pipe 20 extending upwardly from the suction port 11. Fixed on the top of the suction pipe 20 is a starting switch $SW_1$ for the vacuum pump 13. The suction pipe 20 is provided at its side portion with an exhaust port 21, which is connected to a suction port 24 of the vacuum pump 13 through a connecting tube 22, a pressure sensitive switching mechanism 25 and a connecting tube 23.

The pressure sensitive switching mechanism 25 comprises a cap 27 of a resilient material mounted on an annular rib 26 of the base member 12, an L-shaped arm 28 fixed to the top of the cap 27, and a switch $SW_2$ mounted on a printed circuit board 30 for a motor driven circuit. The L-shaped arm is moved upward or downward in response to the expansion or compression of the cap 27.

Figure 3:
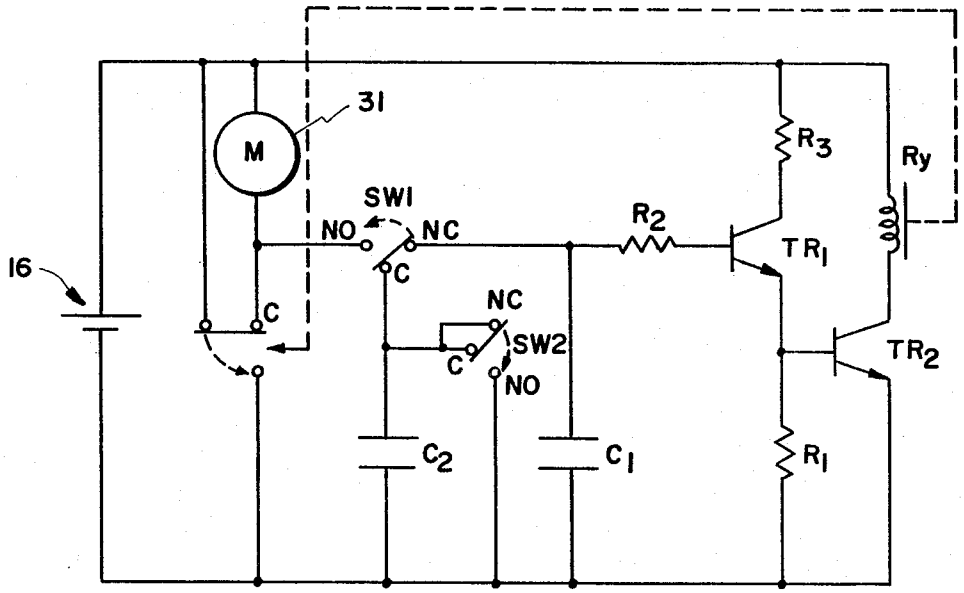
FIG. 3 is a electric circuit used for a storing device of FIG. 1.

The vacuum pump 13 is of a piston-cylinder type and is composed of a cylinder 33 and piston 34 (FIG. 2.) The piston 34 is driven by a motor 31 connected thereto by a crank shaft 32. The motor 31 is controlled, for example, by a driving circuit as shown in FIG. 3. This driving circuit is operated by pushing down the starting switch $SW_1$ mounted on the top of the suction pipe 20. When the switch $SW_1$ is pushed down, a capacitor $C_2$ is charged by a cell battery 16 and a voltage across the capacitor $C_2$ is then applied to a base of a transistor $TR_1$ through a resistor $R_2$ to turn on transistors $TR_1$ and $TR_2$, thereby energizing a relay Ry. The relay contacts switch the supply voltage across the motor 31, so that the vacuum pump is driven by the motor 31. With decrease of the internal pressure of the closed vessel 1, the arm 28 is lowered together with cap 27. When the arm 28 is lowered to the predetermined level, the switch $SW_2$ is pushed off, so that the electric charge in the capacitor $C_2$ is discharged completely through the switch $SW_2$, and the transistors are turned off. As a result, the rely Ry stops the motor 31.

If there is any leakage in the passage from the closed vessel 1 to the vacuum pump 13, the motor 31 is stopped automatically since the capacitor $C_2$ is discharged in a certain period through the resistor $R_2$ and transistor $TR_1$. In this case, the time required for complete discharge is determined by the time constant defined by the values of capacitor $C_2$ and resistor $R_2$.

The thus constructed vacuum storage device 1 may be used in the following manner: Food or other material to be stored is put into the vessel body 2, which is then closed by the lid 3. After this, the pressure reducing device 10 is put on the lid 3. In this case, the position of the device is determined by the projections 19 located in the groove 7 of the lid. The sealing ring 18 is forced on the lid 3 by the weight of the pressure reducing device, so that the air exhaust port 5 of the closed vessel 1 is hermetically connected to the suction port 11 of the pressure reducing device 10.

Under such a condition, the starting switch $SW_1$ is push down to operate the vacuum pump 13 as mentioned above. Since the air in the suction pipe 20 is drawn out by the vacuum pump 13, the check valve 6 is opened by the difference in the pressure between the suction pipe and the closed vessel 1 and the air in the closed vessel 1 is drawn out through the air exhaust port 5.

When the internal pressure of the closed vessel 1 is reduced to the predetermined value, for example, 0.5 atm, the motor driving circuit is turned off by the pressure sensitive switching mechanism 25 and the vacuum pump 13 is stopped. The pressure reducing device 10 is then lifted up to remove it from the closed vessel 1. As a result, the check valve 6 is forced to the lid 3 by the atmospheric pressure and the air exhaust port 5 of the lid 3 is closed. Thus, the interior of the closed vessel 1 is kept at the reduced pressure. The closed vessel 1 may be stored as it is, but it is preferred to provide a protective cover (not shown) on the top of the vessel before storing as occasion demands. In this case, the protective cover is screwed on the threaded portion 8 of the vessel body 2 to cover the check valve 6 and sealing ring 4 from any accidental forces which causes flow of the air into the closed vessel.

Figure 4:
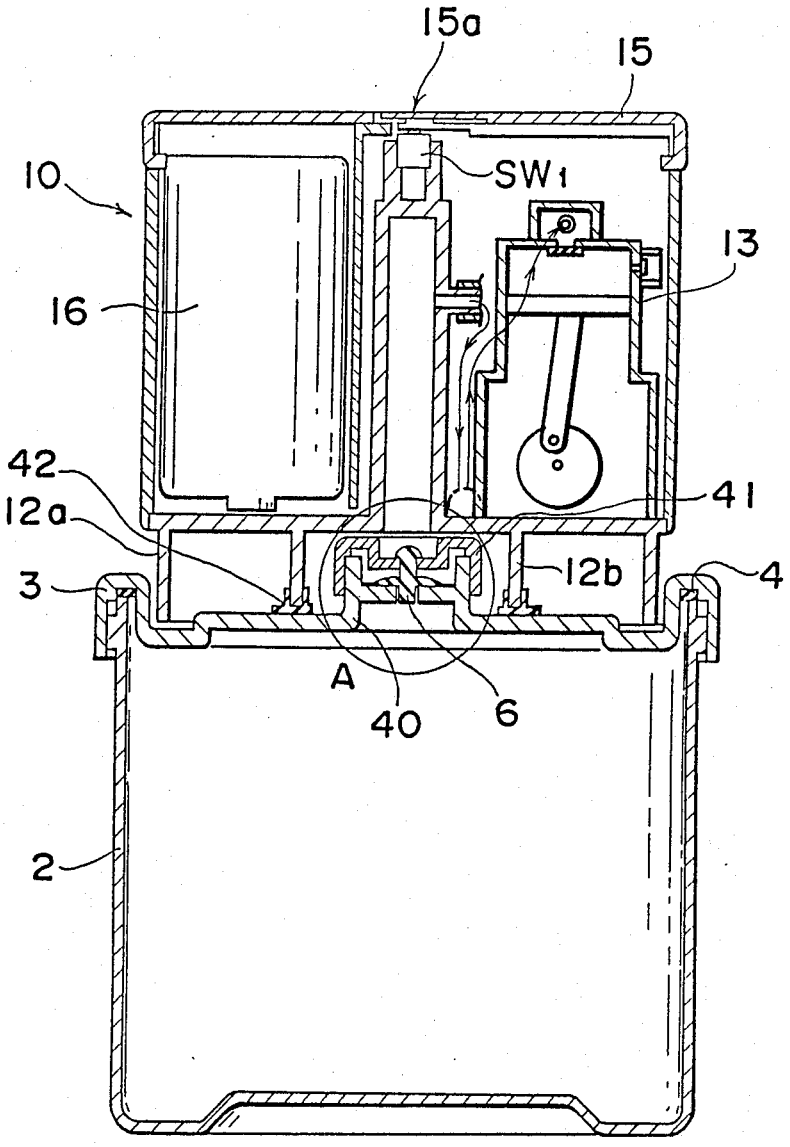
FIG. 4 is a partially cut-away view of a vacuum storage device showing another embodiment of the present invention.
Figure 5:
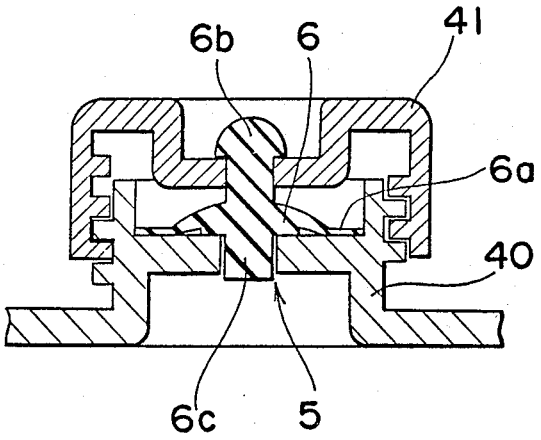
FIG. 5 is an enlarged sectional view of a part encompassed by a circle A in FIG. 4.

Referring now to FIGS. 4 and 5, there is shown another embodiment of a vacuum storage device of the present invention. In this embodiment, the lid 3 is screwed on the vessel body 2 and provided at its central portion with a valve housing 40, on which a cap 41 is screwed. A valve member 6 of a resilient material such as silicone rubber is attached at its upper stem portion **6*b* to the cap 41 and guided at its lower stem portion 6*c* in the air exhaust port 5 of the lid 3**.

In use, food to be stored is put into the vessel body 2, and the lid 3 is screwed on the top of the vessel body 2. The vessel body 2 and lid 3 are sealed by the sealing ring 4. The cap 41 is then turned counterclockwise until a triangular mark (not shown) on the cap 41 is lined up with a triangular mark (not shown) on the lid 3, which indicates a position for exhausting. A gap is formed between the upper surface of the valve 6 and the inner surface of the cap 41 as shown in FIG. 5. This makes it possible to draw out the air in the closed vessel 1 through the valve member 6. Then, the pressure reducing device 10 is placed in its correct position on the lid 3, so that the suction port of the vacuum pump 13 is hermetically connected to the air exhaust port 5 of the closed vessel 1 through the suction pipe and the sealing ring 42.

The vacuum pump 13 is operated by forcing down the central part **15*a* of the cap 15 to push down the starting switch $SW_1$, so that the air is drawn out from the closed vessel 1** until its internal pressure is reduced to the predetermined value.

After exhausting has been completed, the pressure reducing device 10 is removed from the closed vessel 1. At that time, the valve member 6 serves as a check valve to prevent the air from flowing into the closed vessel 1, thus making it possible to keep the closed vessel at a reduced pressure. The cap is then turned clockwise until it stops. The valve member 6 is forced down by the inner surface of the cap 41, and a sealing between the valve member and the valve seat is completed. This makes it possible to store the food at a reduced pressure for a long time.

When opening the closed vessel, the cap 41 is rotated until the valve member is lifted up from the valve seat in the housing 40 to allow the air to flow into the vessel 1.

Figure 6:
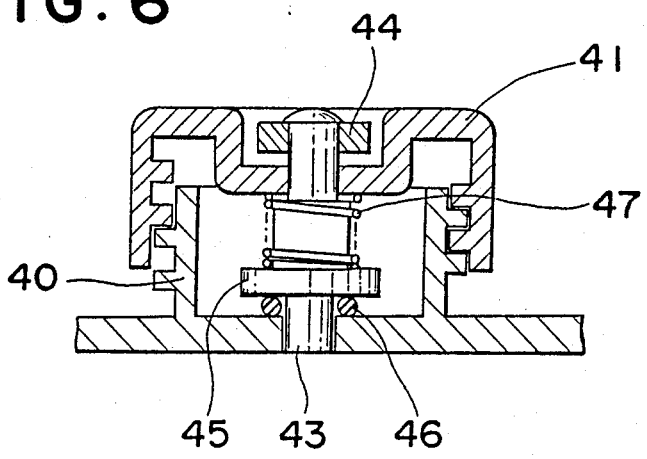
FIG. 6 is a view similar to FIG. 5 showing another embodiment of the present invention.

The above valve member may be modified as shown in FIG. 6. In this embodiment, the valve is composed of a valve member 43 having at its top end a stopper 44 and on the portion in the housing a disk 45, a spiral spring 47 inserted in the housing 40 to press with its lower end against the disk 45 and to push the same downward. An annular sealing member 46 is arranged on the lower portion of the valve member 43 to form a seal between the disk 45 and the valve seat. This valve provides similar effects as that in FIG. 5.

In the above embodiments, the vacuum storage device is so designed that the pressure reducing device is mounted on the closed vessel, so that the air exhaust port is provided in the lid. It is, however, to be noted that the device may be designed so that the closed vessel is mounted on the pressure reducing device. In this case, the air exhaust port is provided in the bottom of the closed vessel while the suction port of the pressure reducing device is provided in its upper wall. However, the greater the bottom surface area of the closed vessel, the greater is the increase in the upper surface area of the pressure reducing device, thus making it difficult to reduce the size of the pressure reducing device. It is therefore preferred that the vacuum storage device is of the former type.

Further, as a means for positioning the pressure reducing device, the lid is provided with the annular groove adapted to receive the legs provided on the bottom of the pressure reducing device. It is possible to design the lid so that the lid may have plural legs inserted in an annular groove provided on the pressure reducing device. Also, the legs and groove may take any shape as occasion demands. Further, the vacuum storage device is not necessarily required to have such a positioning means.

In the above embodiment, the means for connecting the suction port of the pressure reducing device to the air exhaust port of the closed vessel is composed of an annular sealing member. It is, however, possible to use any other means which can be hermetically connected to the pressure reducing device and the closed vessel by contact with them.

The vacuum pump of the pressure reducing device may be of a manual operated or motor driven type. It is preferred to use a motor driven pump to make it easy to operate. Further, the vacuum storage device is provided with a pressure sensitive switching mechanism which detects the internal pressure of the closed vessel and checks the pressure reducing device when the detected pressure has reached to the predetermined pressure. However, it is not necessarily required to provide such a mechanism to the device.

What is claimed is:

1. A vacuum storage device, comprising: a closed vessel for storing food; and a pressure-reducing device removably mounted on said closed vessel to draw air therefrom, said closed vessel comprising a vessel body and a lid removably attached to said vessel body and provided with an air exhaust port and a check valve arranged therein said check valve having an upper stem portion and a lower stem portion, said pressure-reducing device being provided at its bottom with a suction port and with means for hermetically connecting its suction port to the air exhaust port of said closed vessel when said pressure-reducing device is mounted on said vessel, said lid being provided with a valve housing having a cap removably attached thereto, said check valve being housed in said valve housing so that it is attached at its upper stem portion to the cap and guided at its lower stem portion in the air exhaust port of the lid.

2. The vacuum storage device according to claim 1, wherein the air exhaust port of said lid is provided at a central portion of the lid, and wherein the suction port of the pressure-reducing device is formed in its central portion.

3. The vacuum storage device according to claim 1, wherein said pressure-reducing device is provided at its bottom with an annular projection formed coaxially with said suction port and extending downwardly from the bottom of said pressure-reducing device, and wherein said hermetically connecting means comprises a sealing ring attached to the lower end of said annular projection.

4. A vacuum storage device, comprising: a closed vessel for storing food; and a pressure-reducing device removably mounted on said closed vessel to draw air therefrom, said closed vessel comprising a vessel body hermetically closed by a lid, said lid being removably attached to the vessel body and provided with an air exhaust port and a check valve arranged therein, said pressure-reducing device comprising:

a base member provided with a suction port and an annular projection formed coaxially with said suction port, said annular projection being provided with a sealing ring to provide means for hermetically connecting the pressure-reducing device to the closed vessel when said pressure-reducing device is mounted on said closed vessel, a barrel fixed to said base member, a motor-driven vacuum pump arranged in said barrel and connected to said suction port, a motor-driving circuit for controlling said vacuum pump, said motor-driving circuit including a manually operated starting switch adapted to allow the vacuum pump to operate, and a pressure sensitive switching mechanism adapted to allow the vacuum pump to stop when the internal pressure of the closed vessel is reduced to the predetermined value, wherein said pressure sensitive switching mechanism comprises a resilient cap mounted on the base member and connected between said suction port and said vacuum pump by means of connecting tubes, an L-shaped arm fixed to the top of said cap so as to be moved up and down in response to expansion and compression of said cap, and a switch electrically connected to said motor-driving circuit and actuated by said L-shaped arm to close or open said motor-driving circuit.

5. A vacuum storage device according to claim 4, wherein said base member is provided at its central portion with a top-closed suction pipe extending upwardly from the suction port, said suction pipe being connected to said vacuum pump through said connecting tubes and said resilient cap arranged between them.

6. A vacuum storage device according to claim 5, wherein said starting switch is mounted on the top of said suction pipe.

7. A vacuum storage device, comprising: a closed vessel for storing food; and a pressure-reducing device removably mounted on said closed vessel to draw air therefrom, said closed vessel comprising a vessel body hermetically closed by a lid, said lid being removably attached to the vessel body and provided with an air exhaust port and a check valve arranged therein, said pressure-reducing device comprising:

a base member provided with a suction port and an annular projection formed coaxially with said suction port, said annular projection being provided with a sealing ring to provide means for hermetically connecting the pressure-reducing device to the closed vessel when said pressure-reducing device is mounted on said closed vessel, a barrel fixed to said base member, a motor-driven vacuum pump arranged in said barrel and connected to said suction port, a motor-driving circuit for controlling said vacuum pump, said motor-driving circuit including a manually operated starting switch adapted to allow the vacuum pump to operate, and a pressure sensitive switching mechanism adapted to allow the vacuum pump to stop when the internal pressure of the closed vessel is reduced to the predetermined value, wherein said lid is provided with a valve housing with a cap removably attached thereto, said valve having an upper stem portion and a lower stem portion, said valve being attached at its upper stem portion to the cap and guided at its lower stem portion in the air exhaust port of the lid.

* * * * *